US005329892A

United States Patent [19]

Svendsen

[11] Patent Number: 5,329,892

[45] Date of Patent: Jul. 19, 1994

[54] FRAME FOR BED VESSEL

[75] Inventor: Harald Svendsen, Finspong, Sweden

[73] Assignee: Abb Carbon AB, Finspong, Sweden

[21] Appl. No.: 955,704

[22] PCT Filed: Jun. 11, 1991

[86] PCT No.: PCT/SE91/00420

§ 371 Date: Dec. 15, 1992

§ 102(e) Date: Dec. 15, 1992

[87] PCT Pub. No.: WO91/19940

PCT Pub. Date: Dec. 26, 1991

[30] Foreign Application Priority Data

Jun. 15, 1990 [SE] Sweden ..... 9002122-1

[51] Int. Cl.[5] ..... F22B 37/24

[52] U.S. Cl. ..... 122/510; 122/4 D

[58] Field of Search ..... 122/510, 511, 4 D; 165/162

[56] References Cited

U.S. PATENT DOCUMENTS

| | | | |
|---|---|---|---|
| 3,373,721 | 3/1968 | Sheikh . | |
| 3,461,847 | 8/1969 | Jacobs et al. . | |
| 3,861,360 | 1/1975 | Shank, Jr. . | |
| 4,059,075 | 11/1977 | Sainegurski et al. . | |
| 4,240,234 | 12/1980 | Eisinger et al. . | |
| 4,499,860 | 2/1985 | Loomis et al. . | |
| 4,576,120 | 3/1986 | Ammann | 122/510 X |
| 4,760,817 | 8/1988 | Jonsson | 122/510 |
| 5,143,024 | 9/1992 | Yokoyama et al. | 122/510 |
| 5,207,184 | 5/1993 | Kreider | 122/510 |

FOREIGN PATENT DOCUMENTS

| | | |
|---|---|---|
| 7712564-9 | 5/1978 | Sweden . |
| 1146411 | 3/1969 | United Kingdom . |

*Primary Examiner*—Edward G. Favors

*Attorney, Agent, or Firm*—Pollock, Vande Sande & Priddy

[57] . ABSTRACT

A frame structure is provided for a bed vessel in an energy plant with higher or lower pressure in the bed vessel in relation to the surrounding space. The walls of the bed vessel are stiffened by surrounding horizontally extending, continuous frames with stiff corners, beams in the frames are built up from rolled standard beams and each individual frame is supported and guided by devices applied to the bed vessel wall. The devices make possible axial movements of the frame beams in relation to the devices. Anti-twist bars for each frame are arranged by means of crossbars rigidly attached to each frame. The crossbars extend to the adjacent frame. The ends of the crossbars mounted in a web of the adjacent frame, the ends of the crossbars at the mounting point being freely axially movable.

11 Claims, 4 Drawing Sheets

FRAME FOR BED VESSEL

TECHNICAL FIELD

The invention relates to an energy plant with a bed vessel in which a fuel is burnt in a fluidized bed of particulate material, the bed material usually being a mixture of fuel and a sulphur absorbent. The combustion may take place at a pressure close to the atmospheric pressure or at a considerably higher pressure. In the latter case, the pressure may amount to 2 MPa or more. Combustion gases generated in the bed vessel are then utilized in one or more turbines for driving a compressor for supplying the bed vessel with combustion air and a generator which delivers current to an electricity supply network. An energy plant with combustion at elevated pressure is internationally generally referred to as a PFBC energy plant, the letters "PFBC" being the initials of the English expression "Pressurized Fluidized Bed Combustion". In such a plant the bed vessel and usually also a cleaning plant for combustion gases are enclosed within a pressure vessel.

BACKGROUND OF THE INVENTION

In energy plants of the above kind the walls of the bed vessel are subjected to heavy forces because of the pressure difference between the inside and the outside of the bed vessel. In a PFBC energy plant with the bed vessel enclosed in a pressure vessel and being surrounded by compressed combustion air, a pressure difference between the space in the pressure vessel outside the bed vessel and the space inside the bed vessel arises because of the pressure drop in inlet channels and nozzles for the supply of air for fludization of a bed material in the lower part of the bed vessel and a pressure drop in the fluidized bed. This pressure difference may amount to about 0.1 MPa. The side walls of the bed vessel may have the size 10×15 m, so the forces acting on the bed vessel walls will be very great. This, in addition to a high temperature, entails design problems which are difficult to deal with.

The walls of the bed vessel consist of panels of tubes which are connected to intermediate fins. These walls, often called panel walls, may be cooled by feedwater circulating in the tubes. The panel walls are incapable of absorbing the loads caused by the pressure difference between the two sides of the walls. The bed vessel is therefore surrounded by a force-absorbing frame structure. The bed vessel is connected to this frame structure by means of force-transmitting bars or links. In case of a cold plant, the frame structure and the bed vessel have the same temperature. In operation, the bed vessel wall assumes the temperature of the circulating coolant and the frame structure the temperature of the surrounding air. Depending on temperature differences between the bed vessel wall and the force-absorbing frame structure, the bed vessel may expand or contract in relation to the frame structure.

The connection between the frame structure and the bed vessel must be designed in such a way that the difference in expansion does not give rise to impermissible stresses in the bed vessel, the frame structure or the connecting members between these.

German Offenlegungsschrift 2 055 803 shows one way of carrying out the connection between a conventional boiler and a force-absorbing frame.

Another known design already occurs in the PFBC energy plants existing at the Värta plant in Stockholm and at Escatron in Spain. In these plants, a stiffening of the panel walls has been obtained by means of continuous support frames with stiff corners extending horizontally around the bed vessel. These frames have been made in the form of box girders welded-together at the corners and they have been given the ability to absorb thermal movements in the bed vessel, among other things by means of an arrangement with auxiliary beams in the corners of the bed vessel, as shown in European patent application 87117795.2.

The factors which must be taken into consideration when dimensioning beams in a frame construction of the kind mentioned are, among other things, horizontal bending stress caused by forces due to pressure difference along the beam from the panel wall stiffened by the beam, vertical bending stress caused by attached equipment, torsion due to uneven load from vertical auxiliary members which in the upper and lower frames are connected between the frame and the upper edge and lower edge, respectively, of the bed vessel wall, the risk of breaking due to bending in the vertical direction of the beams caused by great axial compressive forces, twisting of the beams, transverse forces, combined stresses and, finally, fatigue conditions.

The above-mentioned box girder design for frames have been chosen because it should withstand all of the different stresses enumerated above. However, a frame structure with box girders has proved to be heavy and material-demanding. In addition, it requires a considerable effort in the welding work to form the box girders in accordance with the requirements.

A basic design with continuous frames, provided with stiff corners, around the bed vessel is desirable in order to reduce deflections and stresses. Conventional solutions with beams which are freely mounted at the ends of the bed vessel corners are not considered to fulfil the demands imposed, among other things because these solutions give higher maximum moments on the beams. On the other hand, a possibility of utilizing standard beam sections in a frame structure with continuous frames with stiff corners is preferred, in order to considerably reduce the weight and reduce the work demanded during manufacturing, which renders the entire design simpler and less expensive. The types of load which particularly must be accounted for when changing from box girders to standard beam sections in a support frame according to the above are primarily breaking due to bending, the risk of twisting, and torsion caused by connected auxiliary beams. The present invention presents a solution to the problems described above.

SUMMARY OF THE INVENTION

The present invention relates to a frame structure for a vertically mounted bed vessel in an energy plant in which the interior of the bed vessel is subjected to a lower pressure than the surrounding space. The walls of the bed vessel are stiffened by horizontally extending, surrounding continuous frames with stiff corners. The frames are preferably made as standard beam sections. Anti-twist bars for each frame are arranged in the form of bars which are rigidly attached to the respective frame and axially movably mounted in the adjacent frame. Vertical auxiliary beams connected to the frames are arranged to extend through the web of the frame beam, thus giving the auxiliary beams free axial movability through the frame webs. Blocks preventing elastic instability of the frames due to bending in the vertical direction are arranged by means of guides on the bed vessel wall. The individual frames rest on brackets and are movable inside clamps on the bed vessel wall.

The intention of providing frames around the bed vessel is for the walls of the bed vessel to be relieved by transferring forces by means of links to the surrounding frame. Since this invention concerns a vertically mounted vessel, frames will be oriented in a horizontal position. To be able to relieve compressive forces on the wall of the bed vessel over the entire wall surface, a plurality of substantially parallel frames are required. As already mentioned, the thermal expansion of the bed vessel must enable the walls to move in relation to the frame structure. To this end, either the force-transmitting links to frames from the wall must be made articulated, or the individual frames be made movable in relation to one another in the vertical direction, enabling individual frames to accompany the wall upon thermal movements thereof. In the invention, this is solved in such a way that each separate frame is supported by brackets on the bed vessel corners, so that these corners support the entire weight of the frame.

In a continuous frame according to the above, a beam at a wall side of the frame is subjected to axial compressive forces which are transmitted to the beam from the beams of adjacent wall sides in the same frame. These great axial compressive forces expose each beam in the frame to forces which may lead to vertical breaking due to bending or, possibly, twisting of the beam, that is to say, the whole beam along a frame side is turned around its axis.

To prevent twisting, bars which are rigidly connected to the beams in a frame and extend towards the next parallel frame, above or below it, are arranged at certain intervals. At this adjacent frame, the bar is movably mounted, in the axial direction of the bar, without giving rise to torque load on the adjacent frame beam when the former frame beam, which is rigidly connected to the bar, tends to become twisted.

The risk of vertical breaking due to bending is counteracted by applying guides for the beam on the bed vessel wall, for example by means of blocks, welded to the bed vessel wall, on a level with the upper and lower edges of the frame beam. These guides give the beam a possibility of horizontal displacement.

The uppermost and lowermost frames and possibly other frames, where required, are connected to auxiliary beams which relieve the bed vessel wall, for example between such a frame and the upper or lower edge of the bed vessel wall. Where previously such auxiliary beams have been used as lintels for frames, these auxiliary beams have generally been connected in an articulated manner, partly with articulated links along the auxiliary beam to the panel wall, partly with one end of the auxiliary beams articulately connected to the frame beam. To provide a good lintel between the thermal movements of the corner and the frame, the auxiliary beam must be made so long that the load from the differential pressure across the wall transferred to the frame beam at the connection of the auxiliary beam to the frame beam becomes considerably greater than on the simple link, connected to the panel wall, on the opposite upper or lower side of the frame beam. This gives rise to torsion in the beam.

In this invention the problem regarding with torsion from a perpendicularly connected auxiliary beam is solved by connecting the auxiliary beam to extend through a central hole in the web of the frame beam. By means of articulated links the auxiliary beam is connected to the bed vessel wall on both sides of the frame beam. When the auxiliary beam transfers load to the frame beam, this takes place through an influence perpendicularly inwards towards the wall with a point force applied at the point of contact of the auxiliary beam with the web of the frame beam at the central hole through the web, without any lever. In this way, no torque loads on the frame beam arise and, accordingly, no torsional effect from perpendicularly connected auxiliary beams arises.

With the devices mentioned above, it is possible to use standard beam sections for a frame structure of the above-mentioned kind, thus reducing the cost of the frame structure. At the same time the weight of the frame structure is reduced compared with the corresponding construction with box beams according to the prior art.

The invention relates to a suspended bed vessel. The invention may, of course, be equally applied to a bottom supported bed vessel, thermal movements in the bed vessel thus displacing the walls of the bed vessel upwards. In addition, no mention has been made of the shape of the bed vessel in the horizontal plane. The bed vessel may be of square, rectangular or polygonal shape, seen in the horizontal section.

DESCRIPTION OF THE PREFERRED EMBODIMENTS

Figure 1:
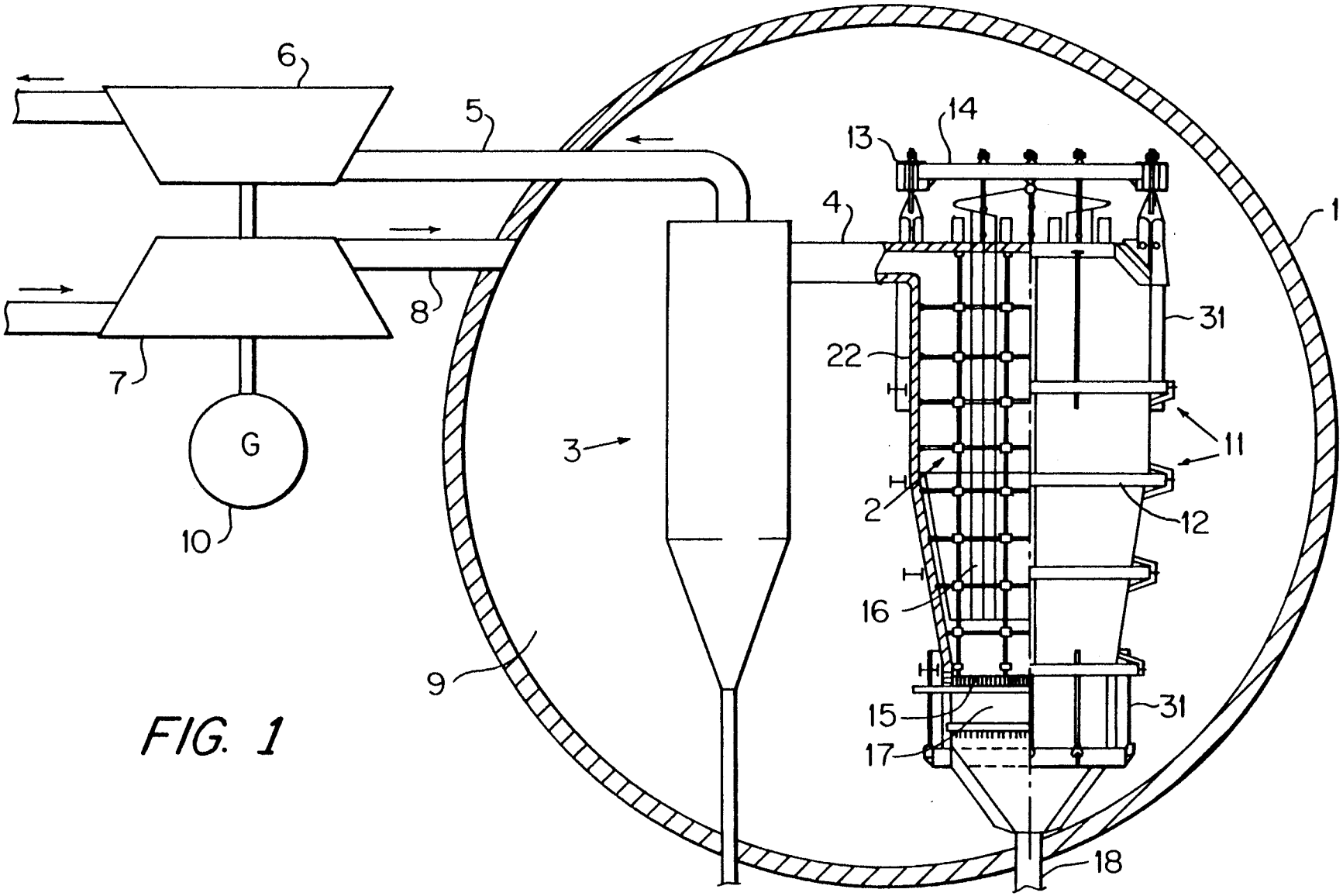
FIG. 1 schematically shows a PFBC energy plant with a bed vessel surrounded by a force-absorbing frame structure.

In the figures, 1 designates a pressure vessel, 2 a bed vessel and 3 a gas cleaner of cyclone type inside the pressure vessel 1. Only one cyclone 3 is shown but in reality the cleaning plant comprises a plurality of parallel groups of series-connected cyclones. Combustion gases generated in the bed vessel are passed through the conduit 4 to the cyclone 3 and from there through the conduit 5 to a turbine 6. This drives a compressor 7, which via a conduit 8 supplies the space 9 in the pressure vessel 1 with compressed combustion air with a pressure which may amount to 2 MPa or more. The turbine 6 also drives a generator 10 which feeds energy to an electricity supply network. The generator 10 can also be utilized as a starter motor.

The bed vessel 2 is surrounded by a frame structure 11 composed of horizontal beams 12 welded together around the bed vessel 2 to form a frame. The bed vessel 2 is suspended from a beam system consisting of longitudinal and transverse verse beams 13, 14. The beams 13 and/or 14 are attached to the wall of the pressure vessel or supported by columns (not shown). The bed vessel has a bottom 15 with air nozzles. Through these nozzles the bed vessel chamber 16 is supplied with air for fluidization of a particulate bed material and for combustion of fuel supplied to the bed. The bottom 15 is provided with openings allowing consumed bed material to fall down into the chamber 17 and be discharged through the discharge conduit 18.

Figure 2:
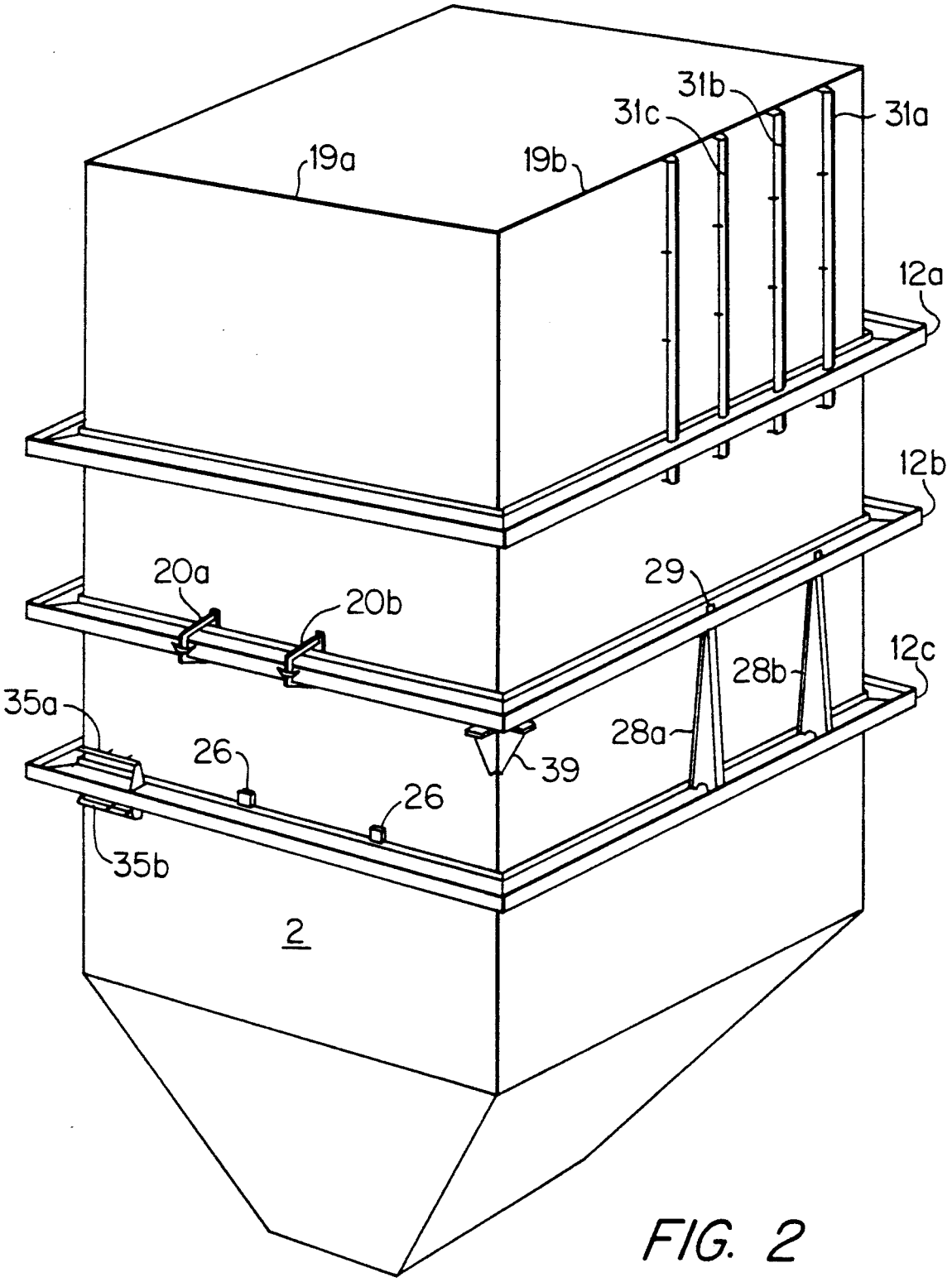
FIG. 2 schematically shows a perspective view of a bed vessel with a selection of devices which are important for the frame structure according to the invention, the number of these devices being limited for the sake of clarity.

The bed vessel comprises gas-tight panel walls 19*a*, 19*b* (see FIG. 2). These panel walls 19*a*, 19*b* may be four or more in number, depending on whether the bed vessel is of rectangular or polygonal shape. Because of the resistance in the nozzles of the bottom 15 and in the fluidized bed, a pressure difference arises between the space 9 around the bed vessel 2 and the bed vessel chamber 16. The pressure difference may amount to 0.1 MPa. The walls 19*a*, 19*b*, which may have a length of 15 m and a height of 10 m or more, will be subjected to very great forces.

To absorb the above-mentioned, normally inwardly-directed forces, the walls of the bed vessel 2 are connected to the horizontal beams 12*a*, 12*b*, . . . of the frame structure by means of clamps 20*a*, 20*b*, . . . , preventing the walls 19*a*, 19*b* from bending inwards and breaking at compressive load against the plane of the walls. The bed vessel walls consist of vertical panels of tubes 21 which are connected to fins (see FIG. 3). The walls 19*a*, 19*b* , are provided on their inner sides with a heat-insulating layer 22. The walls 19*a*, 19*b* are cooled by, for example, feedwater to steam generating tubes (not shown) arranged in the bed vessel.

The horizontal beams are rigidly interconnected into surrounding frames, extending all around the bed vessel 2. The beams in the frames 12*a*, 12*b*, . . . consist of standard beams with an H-shaped section. The frames are completely supported by the walls of the bed vessel by means of brackets 39 in the corners of the bed vessel. Clamps 20 surround the beam 12, allowing the beam to move freely in the horizontal direction inside the clamps 20, at least within the scope of the relatively small horizontal displacements which occur between the frame beam and the panel wall.

The clamps 20 are welded to the panel wall 19 by means of feet 23*a*, 23*b* on the ends of the clamp legs or attached to the panel wall by means of lugs or hooks. The legs of the clamp straddle the frame beam and are joined on the outside of the frame beam by a crossbar 24. Across this crossbar 24 there is applied a brace 25, on the outside of and straddling the crossbar 24, such that the brace 25 will be positioned in the longitudinal direction with the beam 12. The feet of the brace 25 make contact with the beam 12 and are rigidly attached to the frame beam, for example by welding. The recess for the crossbar 24 in the brace 25, between the feet thereof, is of such a size as to allow the change in the angular position of the crossbar 24, between the feet of the brace 25, which is necessary to permit relative motion when a frame beam is displaced in the longitudinal direction due to thermal movements. The clamps 20 have an intentionally slender design in the horizontal direction to allow the above-mentioned horizontal movements of the frame beam. The rigid attachment of the braces 25 to the frame beam 12 and accordingly the locking of the clamps to the frame at its outer flanges also make it possible for the frame 12 to take up temporary overpressures in the bed vessel 2 caused by abnormal situations.

Figure 3:
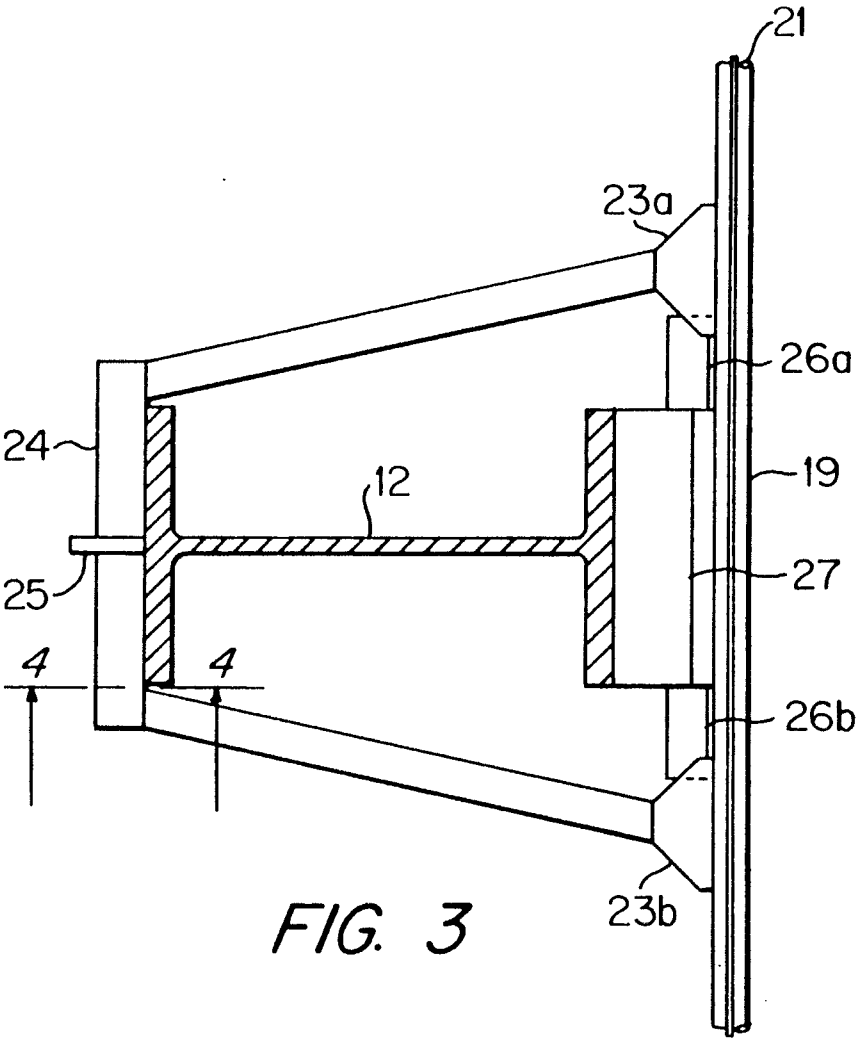
FIG. 3 shows a side view of an embodiment of a clamp which connects the panel wall to a frame.
Figure 2A:
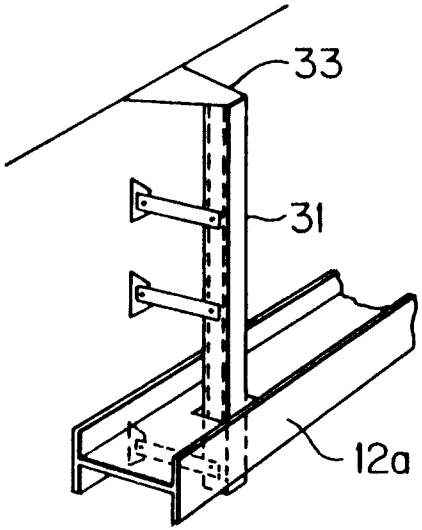
FIG. 2*a* schematically shows a perspective view of the connection of an auxiliary beam to a frame.
Figure 4:
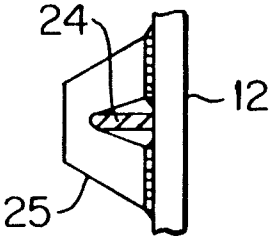
FIG. 4 shows a feature of the outer part of the clamp as a section in the horizontal section.

FIG. 3 also illustrates guides for the frame beam 12. These guides are realized in the form of guide blocks 26*a*, 26*b* attached to the panel wall 19, for example by welding. The guide blocks are disposed both immediately above and immediately below the upper edge and lower edge, respectively, of the frame beam, at the side of the frame beam which faces the panel wall. In this way, the frame beam may be allowed to slide in the horizontal direction along the wall. Normally, there is a certain play between the panel wall and the frame beam. For reasons mentioned below, the beam 12 must be disposed, at several locations, at a longer distance from the panel wall. In these cases, a filling block 27 is secured to the frame beam 12 at the guides. The filling block 27 is suitably welded to the frame beam and is made so thick that it penetrates into the space between the guide blocks 26*a*, 26*b*. A plurality of guide blocks are arranged along the frame beams. The task of the guide blocks 26 is to reduce the risk of breaking due to bending in the vertical direction, caused by heavy axial compressive forces inside the beam 12.

Figure 5:
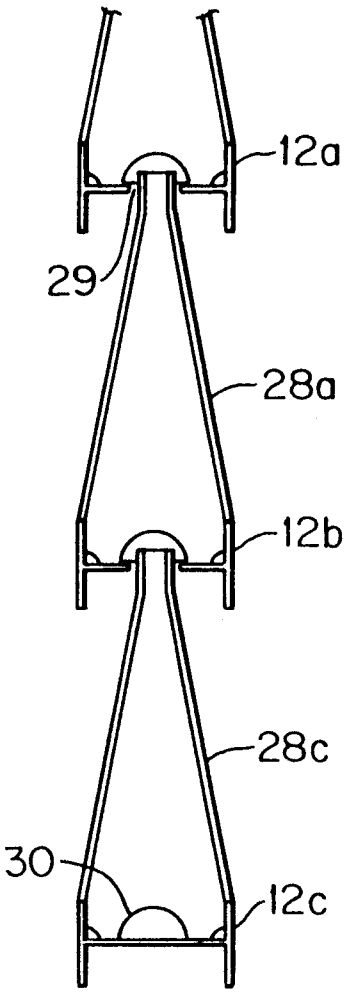
FIG. 5 shows a section through anti-twist bars for several frames.

Between the separate frame storeys there extend anti-twist bars 28*a*, 28*b*, . . . , the function of which is to prevent a whole side section of a frame beam along a panel wall side from turning around its own longitudinal axis due to uneven loads or torsional moments from auxiliary beams connected to the frame beam or components suspended from the frame. Such an anti-twist bar consists of a beam with an I-shaped cross section with a decreasing beam height. The beam in the anti-twist bar 28 is welded with its base, that is the higher part of the beam, across the frame beam 12, perpendicularly out therefrom, and extends in the vertical direction upwards or downwards. In its other end the twist-preventing beam 28 terminates in a portion of even thickness. This other end of the anti-twist bar 28 is, in the vertical direction, freely mounted in a hole 29 provided in the center line of the web of the adjacent frame beam (see FIG. 5). In this way, forces arising at the adjacent frame beam 12*a*, because the beam 12*b* with its associated anti-twist bar 28*a* turns in some direction, only affect the adjacent frame beam 12*a* at the frame web with a point load and thus do not give rise to any additional torque on the adjacent frame beam 12*a*.

Anti-twist bars at the different frame storeys are preferably placed above and line with each other. Openings 30 are provided at the base of the anti-twist bars 28 to make possible vertical movements of the anti-twist bar of an adjacent frame beam, the outer end of the latter anti-twist bar being allowed to extend a small distance inside the base line of the first-mentioned anti-twist bar upon thermal movements between associated frames.

Since it is most simple to provide round holes 29 in the web of the frame beam for the anti-twist devices, such round holes have been provided with guides for, for example, beams used in the anti-twist devices, the cross section of these beams exhibiting rectangular outer contours. These guides consist of short flat bars which are welded to the hole 29 close to the beam in the anti-twist device and on both sides of this hole with the flat bars parallel to each other, so as to form a hole with two straight sides extending in parallel, along the sides of which the anti-twist device may slide inside the hole.

At lintels, such as at the upper or lower edge of the bed vessel, vertical auxiliary beams 31 are provided, for example consisting of U-beams and articulately fixed to the bed vessel by links 32 according to known technique. In this invention, the auxiliary beam is not secured with its end to the frame beam 12 but extends through the frame beam through a hole at the web thereof. Thus, the auxiliary beam 31 is linked with the panel wall 19 on either side of the wall but displaceable in the vertical direction through the frame beam. At the same time, the hole in the frame beam is adapted such that the auxiliary beam makes contact with the inside of the hole so that forces acting on the auxiliary beam, by loads transmitted from the panel wall, are in their turn transmitted and absorbed by the frame beam. Since these forces, transmitted from the auxiliary beam, act in the web of the frame beam and through the center line thereof, torsional loads transmitted to the frame beam are avoided.

At its point of connection to the edge of the bed vessel, the auxiliary beam 31 is fixed to a flexible plate 33. This flexible plate is intended to provide a rigid connection to the edge of the bed vessel but may be extended in the vertical direction upon thermal movements of the bed vessel wall. A support heel 34, which supports downwards against the frame beam and carries the weight of the auxiliary beam, is welded to the auxiliary beam.

FIG. *7a* and *7b* show a preferred embodiment of horizontal auxiliary beams 35 which, in principle, are designed as the auxiliary beams with a system of links described in EP 87117795.2. In the embodiment shown, the connection to the frame beam is also in this case made by means of a flexible plate 36, which supports the auxiliary beam 35 and takes up load from this for transmission to the frame beam, but which also provides a flexible connection in the horizontal direction. Horizontal auxiliary beams 35*a*, 35*b* have been arranged both above and below the same frame at a corner of the bed vessel. By this symmetry, the occurrence of a torque load on the frame beam 12 is counteracted.

FIG. *7a* and *7b* show also shows a downcomer 37 provided at the corner of the bed vessel. This downcomer is not provided flush with the bed vessel wall but projects somewhat outside the web of the wall. To avoid a complicated design with frames 12 bent around these downcomers 37, the frames are instead located at a somewhat greater distance from the wall, as mentioned above. In certain corners broken corners in a frame may occur, that is, smaller sections of a frame beam have been welded together to form a bent corner of the frame, the frame then following the downcomer 37 around the corner.

Figure 8:
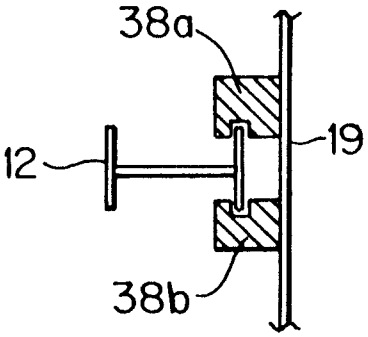
FIG. 8 illustrates an alternative arrangement for suspension and guiding of a frame beam connected to a wall of the bed vessel by means of blocks with slots fixed to the wall.
Figure 7A:
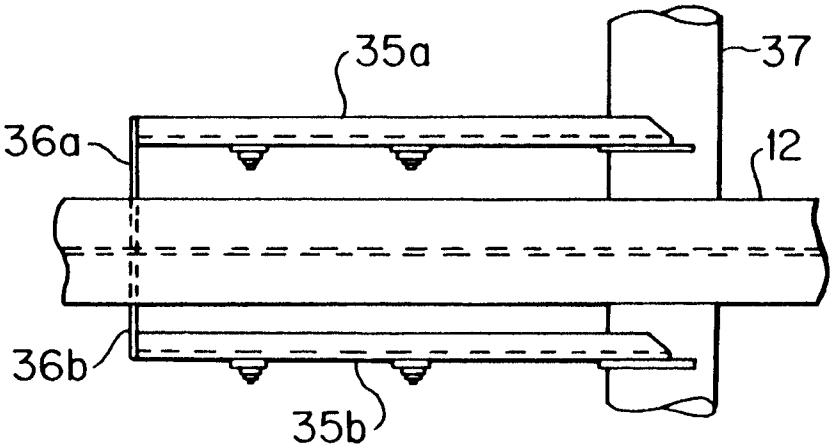
FIG. 7*a* shows a side view of the embodiment of horizontal auxiliary beams at the corners of a bed vessel.
Figure 7B:
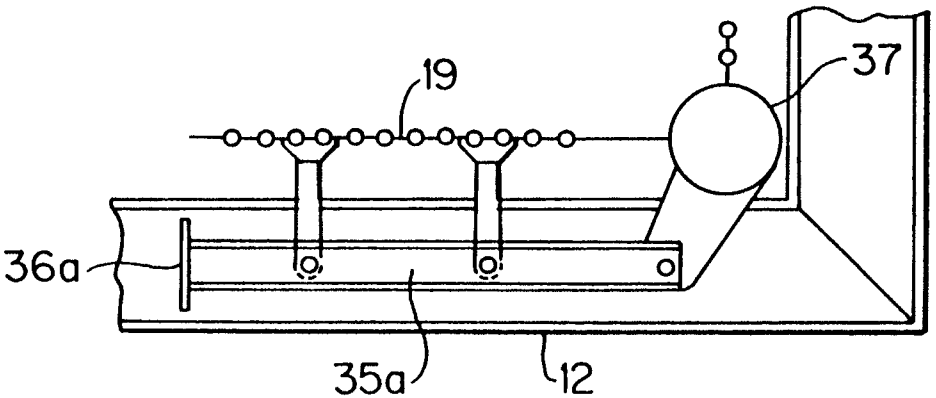
FIG. 7*b* shows a plan view of the embodiment of the auxiliary beam shown in FIG. 7*a*.
Figure 6:
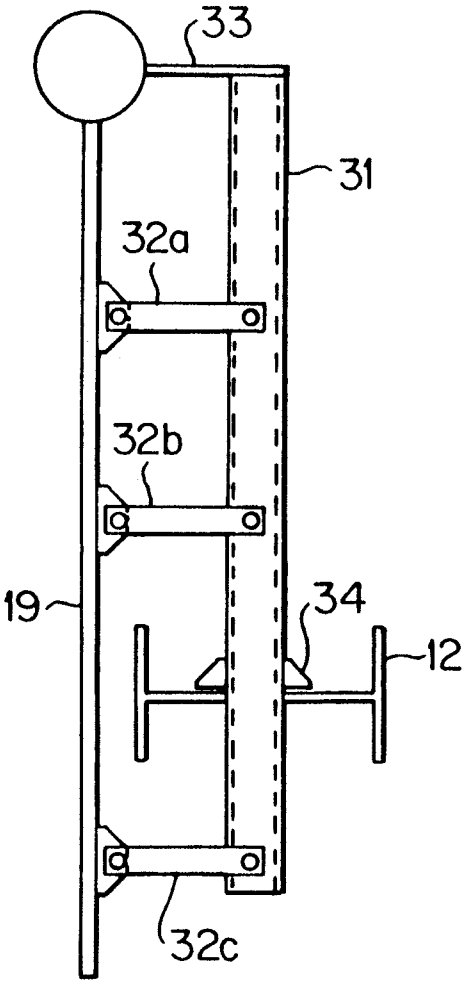
FIG. 6 shows a side view of the embodiment of the connection of an auxiliary beam to a frame.

A variant of the connection between the frame beam 12 and the bed vessel wall 19 is shown in FIG. 8. Here, blocks 38*a* and 38*b* have been arranged, with slots for the inner vertical flange of the H-beam which forms the frame 12. The blocks 38*a* and 38*b* are applied to the panel wall 19 immediately above and immediately below the inner flange of the frame beam 12, such that the upper and lower edges of the inner flange may run freely in the horizontal direction in the slots of the blocks 38*a* and 38*b*. These blocks 38*a* and 38*b* thus replace both guides 26 and clamps 20. Since in this variant the flange of the frame beam is locked to a slot in the blocks 38, the frame 12 is also able to take up an overpressure in the bed vessel, arising due to abnormal conditions therein.

I claim:

1. A frame structure for a bed vessel in an energy plant with higher or lower pressure in the bed vessel in relation to the surrounding space, said frame structure comprising:

horizontally extending, continuous frames with stiff corners surrounding walls of the bed vessels to stiffen the walls;

said frames including beams which are built up from rolled standard beams;

each individual frame being supported and guided by devices applied to the bed vessel wall, said devices making possible axial movements of the frame beams in relation to said devices; and wherein anti-twist bars are provided for each frame including crossbars rigidly attached to each frame, said crossbars extending to the adjacent frame with the ends of the crossbars mounted in a web of said adjacent frame, ends of said crossbars at said mounting point being freely axially movable.

2. A frame structure according to claim 1, wherein said frames are disposed in clamps surrounding the frames, said clamps being mounted across the frame and the legs of the clamps applied to the wall of the bed vessel and arranged so as to allow a certain relative sliding movement between the frame and the clamps at the contact surfaces thereof.

3. A frame structure according to claim 2, wherein the outer crossbar of a clamp is enclosed by a brace extending along the frame, and feet of said brace are welded to the frame.

4. A frame structure according to claim 1, wherein said beams in the frames are made of beams with an H-shaped section and wherein the frame is polygonal and made with broken or perpendicular corners or with the same angle as that of an adjacent bed vessel corner.

5. A frame structure according to claim 1, wherein said anti-twist bars are made of beams with an I-shaped section, one end of each beam is rigidly connected to the frame, and wherein the beam tapers outwardly from the connection and terminates at its other end in a portion of even width, and wherein said portion is mounted in a hole provided in the web of the adjacent frame beam.

6. A frame structure according to claim 4, wherein vertical auxiliary beams connected to the frame are made to extend through a web of the frame and mounted at the web of the frame with free axial movability.

7. A frame structure according to claim 6, wherein vertical auxiliary beams connected to the frame are connected to the wall of the bed vessel by means of articulated links on both sides of the frame, wherein the auxiliary beam is fixed by means of a flexible plate to an edge of the bed vessel and wherein the auxiliary beam is supported against the frame beam by a support heel.

8. A frame structure according to claim 1, wherein breaking-preventing means for the frame int he form of guides which allow free horizontal movability for the frame are arranged on the wall of the bed vessel.

9. A frame structure according to claim 8, wherein the breaking-preventing means are made in the from of blocks applied to the wall of the bed vessel along the upper and lower edges of the frame beam, allowing an inside of the frame beam to slide horizontally along the wall between these blocks, and, where required, filling blocks are applied on the inside of the frame beam at the breaking-preventing means, said filling blocks filling up, in depth, a space between two cooperating breaking-preventing means at the upper and lower edges of the frame beam to make it possible to guide the frame beam also in case of a large distance between the wall and the frame beam.

10. A frame structure according to claim 1, wherein blocks with slots are applied along the wall of the bed vessel, the upper and lower edges of an inner vertical flange of the frame beam running in said slots and being freely mounted in the axial direction.

11. A frame structure according to claim 1, wherein horizontal auxiliary beams are connected to the frame by means of flexible plates.

* * * * *